US008876108B2

(12) United States Patent
Uchida et al.

(10) Patent No.: US 8,876,108 B2
(45) Date of Patent: Nov. 4, 2014

(54) SHEET TRANSPORT APPARATUS AND IMAGE FORMING APPARATUS

(75) Inventors: Wataru Uchida, Yokohama (JP); Ryo Iwasawa, Yokohama (JP); Yasuhiko Fuse, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/469,534

(22) Filed: May 11, 2012

(65) Prior Publication Data

US 2013/0161901 A1 Jun. 27, 2013

(30) Foreign Application Priority Data

Dec. 26, 2011 (JP) ..... 2011-283367

(51) Int. Cl.
*B65H 9/04* (2006.01)
*B65H 9/00* (2006.01)

(52) U.S. Cl.
CPC ..... *B55H 9/06* (2013.01)
USPC ..... 271/243; 271/226; 271/245; 271/246

(58) Field of Classification Search
CPC ..... B65H 9/00; B65H 9/06
USPC ..... 271/243–246, 226
See application file for complete search history.

(56) References Cited

U.S. PATENT DOCUMENTS 4,218,738 A * 8/1980 Matyas et al. ..... 705/72
4,473,222 A * 9/1984 Simmons et al. ..... 271/245
7,308,227 B2 * 12/2007 Ahn ..... 399/388
7,546,468 B2 * 6/2009 Fujiwara et al. ..... 713/176
7,584,960 B2 * 9/2009 Ha ..... 271/246
7,685,435 B2 * 3/2010 Fujiwara et al. ..... 713/191
7,849,331 B2 * 12/2010 Fujiwara et al. ..... 713/193
8,308,159 B1 * 11/2012 Manor et al. ..... 271/245
8,342,519 B2 * 1/2013 Watanabe et al. ..... 271/243
8,382,099 B2 * 2/2013 Mori ..... 271/230
8,496,241 B2 * 7/2013 Osakabe et al. ..... 271/121
2003/0215274 A1 * 11/2003 Ahn ..... 399/388
2008/0143045 A1 * 6/2008 Yu et al. ..... 271/245
2008/0251998 A1 * 10/2008 Muneyasu et al. ..... 271/227
2010/0310280 A1 * 12/2010 Kondo et al. ..... 399/297
2011/0089628 A1 * 4/2011 Watanabe et al. ..... 271/110
2011/0180986 A1 * 7/2011 Okawa et al. ..... 271/127
2012/0153565 A1 * 6/2012 Deno ..... 271/226

FOREIGN PATENT DOCUMENTS

JP 3768576 B2 4/2006

* cited by examiner

*Primary Examiner* — Patrick Cicchino
(74) *Attorney, Agent, or Firm* — Fitzpatrick, Cella, Harper & Scinto

(57) ABSTRACT

A sheet transport apparatus includes: a transport portion that transports a sheet; a skew correction portion against which a leading edge of the sheet transported by the transport portion abuts for skew correction, the skew correction portion moving to a position where the skew correction portion does not hinder the transport of the sheet after the skew correction; and a plurality of sheet abutting portions that is provided in the skew correction portion and against that the leading edge of the sheet transported by the transport portion abuts, the plurality of sheet abutting portions respectively including a resin member, and an abutting portion which is provided in the resin member and having an abrasion resistance higher than that of the resin member, and against which the leading edge of the transported sheet abuts.

24 Claims, 7 Drawing Sheets

SHEET TRANSPORT APPARATUS AND IMAGE FORMING APPARATUS

BACKGROUND OF THE INVENTION

1. Field of the Invention

The present invention relates to a sheet transport apparatus and an image forming apparatus.

2. Description of the Related Art

Conventionally, image forming apparatuses such as copiers, printers and facsimile machines include an image forming portion and a sheet transport apparatus that transports sheets to the image forming portion by transport rollers. In the conventional image forming apparatuses, when a sheet is transported, the sheet may skew because of, e.g., deformation or misalignment of the transport rollers. In the image forming apparatuses, the accuracy of an image forming position relative to a sheet greatly depends on the position of the sheet relative to the image forming portion. Therefore, accurate positioning of a sheet relative to the image forming portion is an important factor for image quality.

In the conventional image forming apparatuses, a skew correction portion is provided in the sheet transport apparatus. Skew of a sheet is corrected by the skew correction portion to enhance the image forming position accuracy. Examples of such image forming apparatuses include an apparatus that includes a shutter member biased in a direction opposite to a sheet transport direction by, e.g., a spring as a skew correction portion (see Japanese Patent No. 3768576).

With such shutter-type skew correction apparatus, a transported sheet abuts against an abutting portion of the shutter member to form a loop. Consequently, a leading edge of the sheet follows the abutting portion, whereby skew of the sheet is corrected. Ordinarily, the abutting portion of the shutter member against which a leading edge of a sheet abuts is made of a resin member.

In conventional sheet transport apparatuses including a shutter member, when a leading edge of a sheet abuts against an abutting portion of the shutter member, the leading edge of the sheet then moves in a width direction perpendicular to a sheet transport direction so as to follow the abutting portion while pressure contacting with the abutting portion. At this time, if the abutting portion of the shutter member is made of a resin member, when the leading edge of the sheet moves in the width direction while contacting with the abutting portion, a part of the abutting portion against that the leading edge of the sheet abuts is whittled by the sheet and a groove portion is formed.

If the groove portion is formed in the abutting portion of the shutter member, when other sheets are subsequently transported, the groove portion is gradually deepened. As a result, a leading edge of a sheet may be caught in the groove portion, causing a transport failure. As described above, when an abutting portion of a shutter member is made of a resin member, a groove portion may be formed in the abutting portion of the shutter member during a long period of use, and if a leading edge of a sheet is caught in the groove portion, a transport failure may occur.

SUMMARY OF THE INVENTION

The present invention has been made in view of such circumstances, and an object of the present invention is to provide a sheet transport apparatus and an image forming apparatus enabling stable sheet transport even after a long period of use.

The present invention provides a sheet transport apparatus including: a transport portion that transports a sheet; a skew correction portion against which a leading edge of the sheet transported by the transport portion abuts for skew correction, the skew correction portion moving to a position where the skew correction portion does not hinder the transport of the sheet after the skew correction; and a plurality of sheet abutting portions that is provided in the skew correction portion and against that the leading edge of the sheet transported by the transport portion abuts, the plurality of sheet abutting portions respectively including a resin member, and an abutting portion which is provided in the resin member and having an abrasion resistance higher than that of the resin member, and against which the leading edge of the transported sheet abuts.

The present invention enables stable sheet transport even after a long period of use.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

Figure 1:
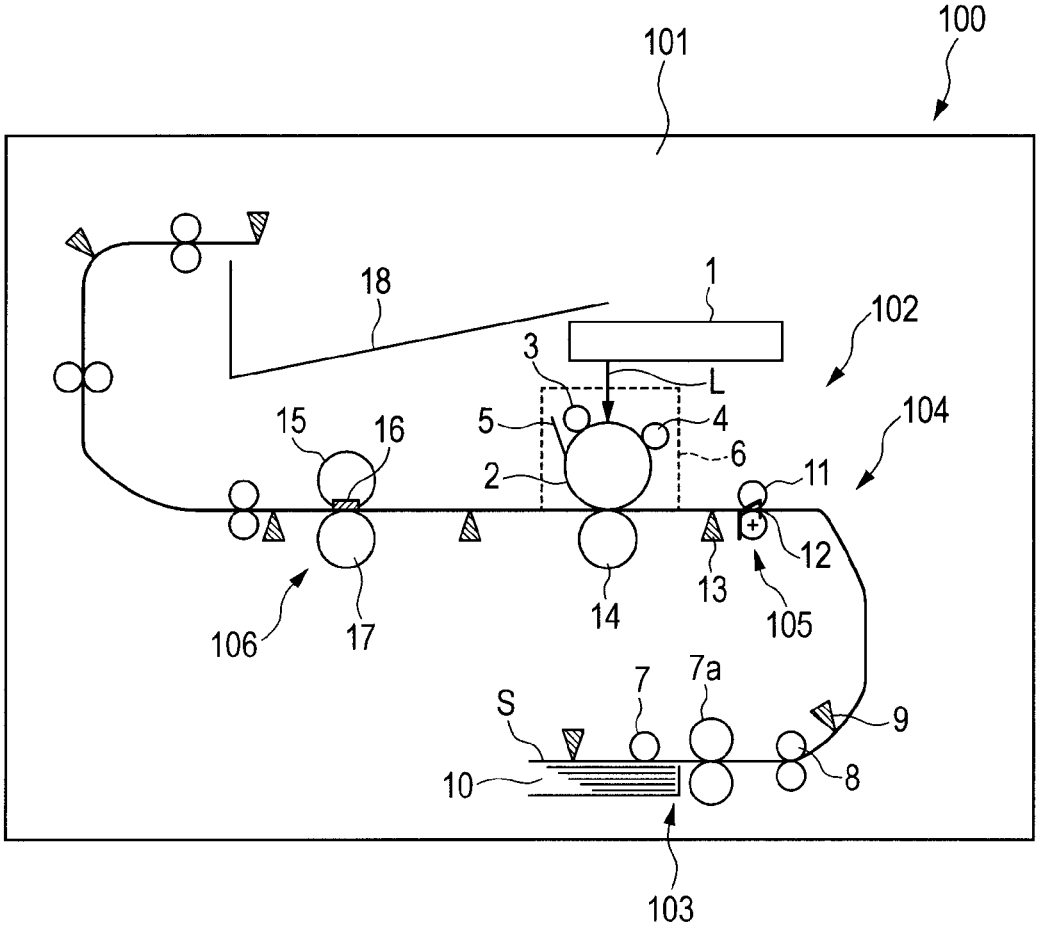
FIG. 1 illustrates a schematic configuration of a laser beam printer, which is an example of an image forming apparatus including a sheet transport apparatus according to a first embodiment.

Hereinafter, embodiments of the present invention will be described in details with reference to the drawings. FIG. 1 illustrates a schematic configuration of a laser beam printer, which is an example of an image forming apparatus including a sheet transport apparatus according to a first embodiment of the present invention. In FIG. 1, a laser printer 100, a printer body 101, an image forming portion 102, a sheet feed apparatus 103, and a sheet transport apparatus 104 that transports sheets sent out by the sheet feed apparatus 103 to the image forming portion 102 are illustrated.

The image forming portion 102 includes a laser optical system 1, and an image forming unit 6 that includes a photosensitive drum 2, a charge roller 3, a developing roller 4 and a cleaning blade 5. The sheet feed apparatus 103 includes a sheet feed roller 7 that feeds sheets S stacked in a sheet cassette 10 and a separation roller pair 7*a*. The sheet transport apparatus 104 includes transport rollers 8, registration rollers 11 and a shutter member 12, and also includes a skew correction apparatus 105 that corrects skew of a sheet.

In the later printer 100, upon input of image information and a print job signal from, e.g., a non-illustrated external personal computer, the sheet feed roller 7 rotates, whereby sheets S stacked in the sheet cassette 10 are fed. Subsequently, the sheets S fed from the sheet cassette 10 are separated one by one by the separation roller pair 7*a*, and then transported by the transport rollers 8.

After detection of transport of a sheet S by a transport sensor 9, the sheet S abuts against a shutter member 12 biased in a direction opposite to a sheet transport direction, before reaching the registration rollers 11. Subsequently, the sheet S is further transported while abutting against the shutter member 12. Consequently, a leading edge of the sheet follows the shutter member 12 while forming a loop, whereby skew of the sheet S is corrected. After the correction resulting from the leading edge of the sheet following the shutter member 12, the sheet S enters a nip portion formed by the registration rollers 11 while pushing the shutter member 12 back. Subsequently, the sheet S is transported by the registration rollers 11.

Next, the leading edge of the sheet S transported by the registration rollers 11 is detected by a leading edge sensor 13. Then, based on the input image information, a laser beam is emitted from the laser optical system 1 onto the photosensitive drum 2 charged by the charge roller 3. The photosensitive drum 2 that is rotating is scanned by the laser, whereby a latent image is formed on the photosensitive drum. The latent image is developed by the developing roller 4 using toner, whereby a toner image is formed on the photosensitive drum.

After the formation of the toner image on the photosensitive drum, the sheet S reaches a transfer portion including the photosensitive drum 2 and a transfer roller 14. In the transfer portion, the toner image on the photosensitive drum is transferred onto the sheet S by the transfer roller 14. After the transfer of the toner image, the toner remaining on the photosensitive drum 2 is cleaned by the cleaning blade 5.

Next, the sheet S with the toner image transferred thereon is transported to a fixing unit 106 that includes a fixing film 15, a heater 16 and a pressure roller 17. In the fixing unit 106, the sheet S is heated and pressurized, whereby the toner image on the sheet is fixed onto the sheet. The sheet S with the toner image fixed thereon is subsequently output to an output tray 18.

Figure 2:
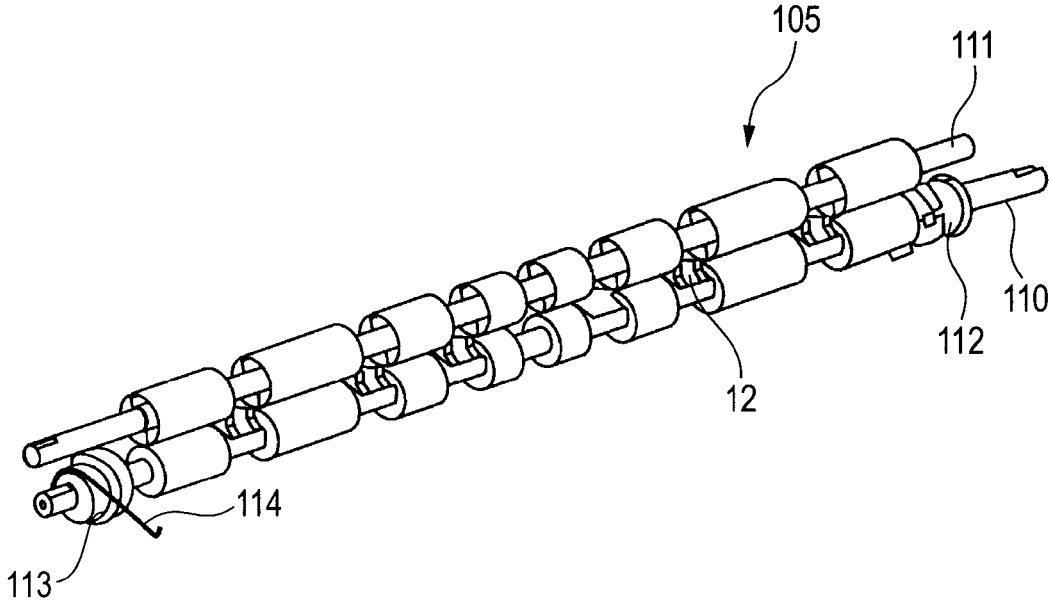
FIG. 2 illustrates a configuration of a skew correction apparatus provided in the sheet transport apparatus.

As illustrated in FIG. 2, the skew correction apparatus 105 is disposed downstream of the transport rollers 8 which is a first sheet transport portion in the sheet transport direction. The skew correction apparatus 105 includes a drive roller 110 and a driven roller 111 which are included in a second sheet transport portion that transports sheets. The skew correction apparatus 105 also includes the shutter member 12 as a skew correction portion that corrects skew of a sheet.

The shutter member 12 is supported by outer peripheral portions of bearings 112 and 113 that rotatably support the drive roller 110, and can swing with the bearings 112 and 113 as supporting points. Furthermore, the shutter member 12 is held at a position where the shutter member 12 abuts against a sheet on the upstream side of the nip portion formed by the drive roller 110 and the driven roller 111 in the sheet transport direction while being biased by a coil spring 114 in a direction in which the shutter member 12 hinders the transport of a sheet S.

Figure 3A:
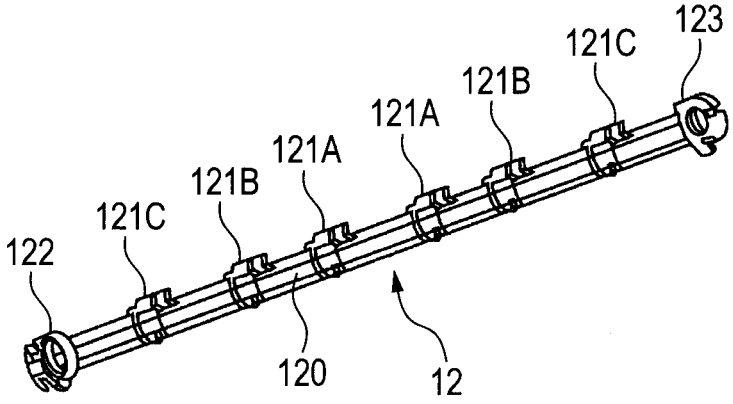
FIGS. 3A and 3B illustrate a configuration of a shutter member provided in the skew correction apparatus.
Figure 3B:
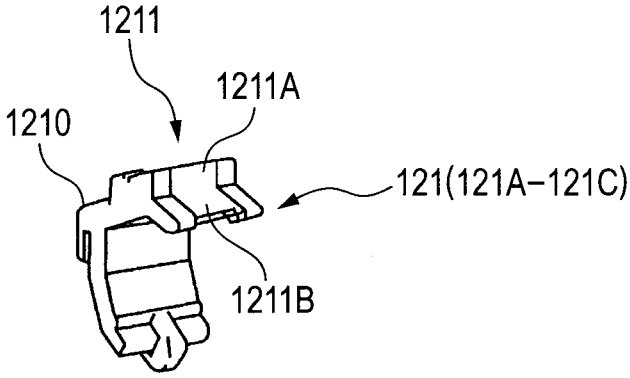

FIGS. 3A and 3B illustrate a configuration of the shutter member 12. As illustrated in FIG. 3A, the shutter member 12 includes a metal plate member 120, and swing support portions 122 and 123 supported by the outer peripheral portions of the bearings 112 and 113 illustrated in FIG. 2. Furthermore, the shutter member 12 includes shutter portions 121 (121A to 121C), which are a plurality of sheet abutting portions, on the metal plate member 120. The sheet abutting portions are provided in a protruding manner in a width direction perpendicular to the sheet transport direction and abut against a sheet.

As illustrated in FIG. 3B, each shutter portion 121 includes a shutter portion body 1210, which is a sheet abutting portion body made of a resin member, and a thin metal plate member 1211 attached to the shutter portion body 1210. The thin metal plate member 1211, which is an abutting portion against which a sheet abuts, includes an abutment surface 1211A, which is an abutment part against which a leading edge of a sheet S abuts, and a restriction portion 1211B that prevents a sheet S from entering a gap between an inner periphery of the shutter portion 121 and an outer periphery of a shaft of the drive roller 110. In the present embodiment, the plurality of shutter portions 121 provided in the direction perpendicular to the sheet transport direction and the swing support portions 122 and 123 are manufactured by being forming on the metal plate member 120 by integral molding. Since each shutter portion body 1210 is made of a resin member, a shape of the shutter portion body 1210 can freely be designed.

Next, a skew correction operation performed by the skew correction apparatus 105 including the shutter member 12 will be described. A sheet transported by the transport rollers 8 reaches the skew correction apparatus 105 that is in the standby state illustrated in FIG. 4A. A leading edge of the sheet S comes into contact with the abutment parts of the shutter portions 121 (shutter member 12), the abutment parts including the abutment surfaces 1211A of the thin metal plate member 1211. Subsequently, the sheet S is further transported in such state, and then as illustrated in FIG. 4B, the leading edge of the sheet S follows the abutment parts of the respective shutter portions 121 while the sheet S forming a loop, whereby skew of the sheet S is corrected.

Next, the sheet S subsequent to the skew correction enters the nip portion formed by the drive roller 110 and the driven roller 111 while pressing the shutter member 12 against the coil spring 114 illustrated in FIG. 2. Subsequently, as illustrated in FIG. 4C, the sheet S is pinched and transported by the drive roller 110 and the driven roller 111 toward the transfer portion while moving the shutter member 12 to a position where the shutter member 12 does not hinder the transport of the sheet.

Upon a rear edge of the sheet passing through the shutter portion 12, the shutter portion 12 is turned by a force of the coil spring 114 to return to a standby position where the shutter portion 12 abuts against a non-illustrated stopper. Since the shutter portion body 1210 is made from a resin, which is light in weight, an inertia moment of the shutter member 12 during the turn is small. Accordingly, an impact on the shutter member 12 colliding with the stopper when returning to the standby position is small. Therefore, the shutter member 12 has only a small bound when the shutter member 12 collides with the stopper, and thus, the shutter member 12 can be stopped at the standby position promptly.

Figure 5A:
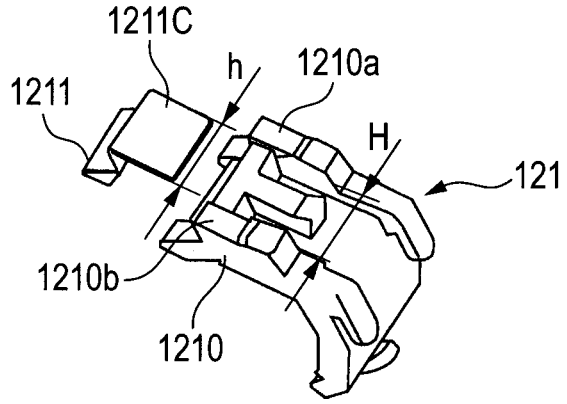
FIGS. 5A, 5B and 5C are a first set of diagrams illustrating a configuration of a shutter portion provided in a protruding manner in the shutter member.
Figure 5B:
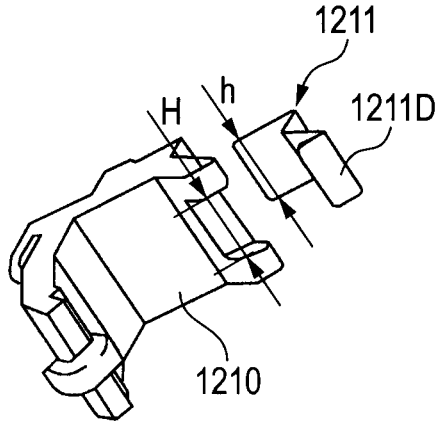
Figure 5C:
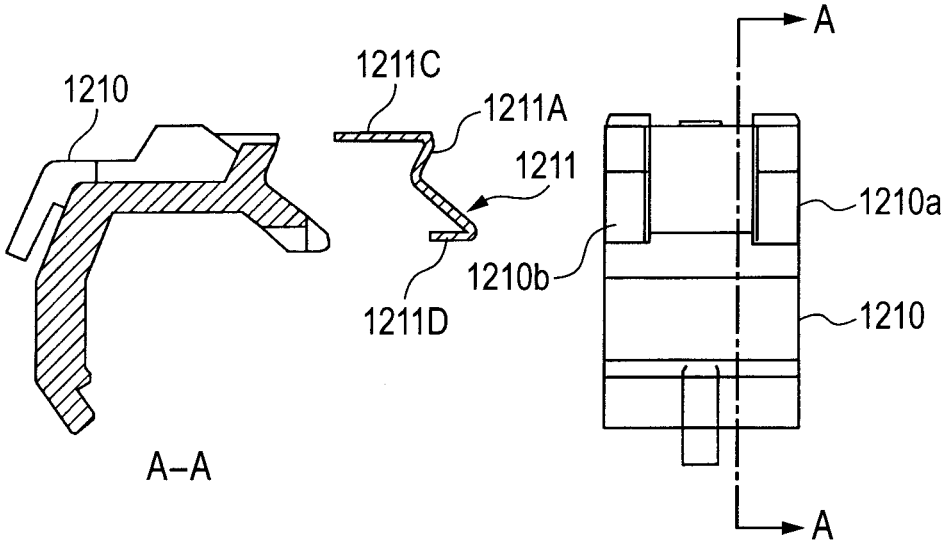
Figure 6A:
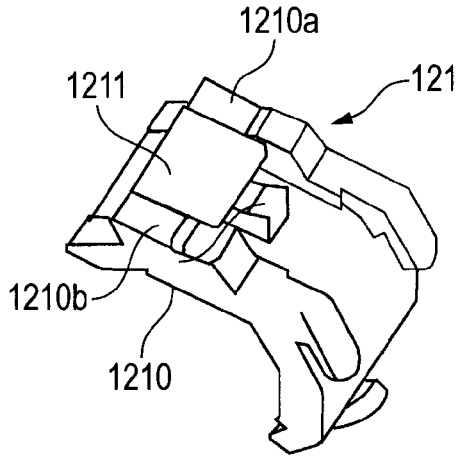
FIGS. 6A, 6B and 6C are a second set of diagrams illustrating the configuration of the shutter portion.
Figure 6B:
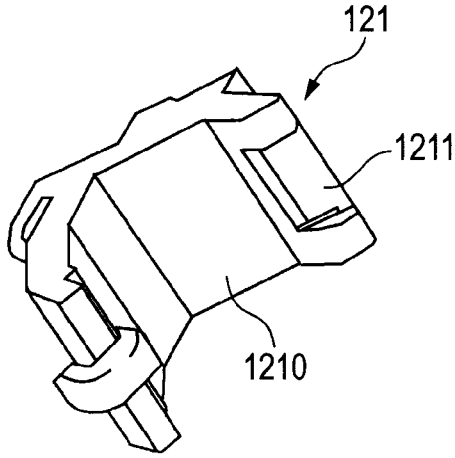
Figure 6C:
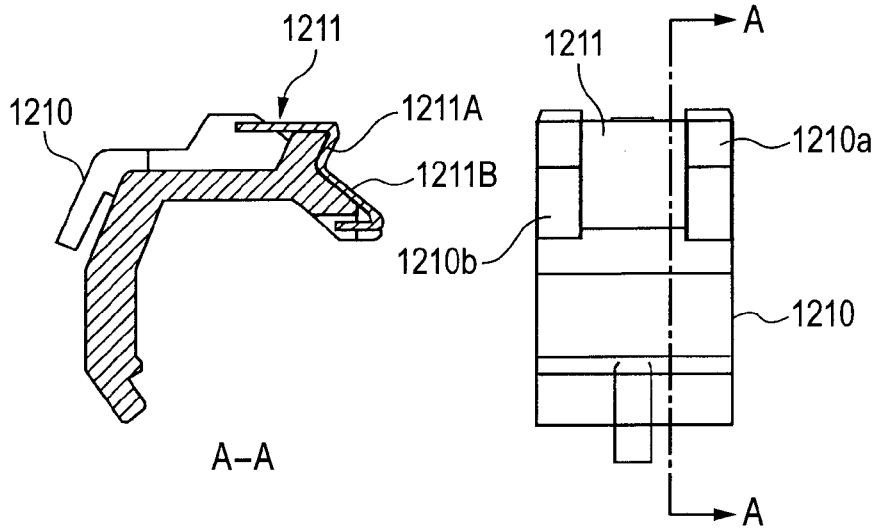

FIGS. 5A to 5C and 6A to 6C illustrate a configuration of a shutter portion 121. FIGS. 5A to 5C illustrates a state before attaching the thin metal plate member 1211 to a shutter portion body 1210 which is a portion to which a thin metal plate member 1211 is attached. FIGS. 6A to 6C illustrate a state in which a thin metal plate member 1211 has been attached to a shutter portion body 1210. Here, FIGS. 5A and 6A are upper perspective views, FIGS. 5B and 6B are lower perspective views, and FIGS. 5C and 6C are cross-sectional views along line A-A.

In the present embodiment, a press fit method is employed as a method for attaching a thin metal plate member 1211 to a shutter portion body 1210. Thus, as illustrated in FIG. 5C, a thin metal plate member 1211 includes two (upper and lower) press fit portions 1211C and 1211D between which a surface opposite to the abutment surface 1211A is interposed. In other words, the thin metal plate member 1211 includes the abutment surface 1211A and the press fit portions 1211C and 1211D provided at opposite ends of the abutment surface 1211A so as to face each other, the press fit portions 1211C and 1211D being press-fitted into a shutter portion body 1210.

As illustrated in FIGS. 5A and 5B, a shutter portion body 1210 includes two receiving portions 1210*a* and 1210*b* provided so as to face each other in the width direction. The two press fit portions 1211C and 1211D of the thin metal plate member 1211 have a same dimension h in the width direction, and in the present embodiment, the dimension h is 5.60 mm. A space H in the width direction between the two receiving portions 1210*a* and 1210*b* of the shutter portion body 1210 is 5.52 mm. For the shutter portion body 1210 into which the thin metal plate member 1211 is press-fitted, polyacetal, which is a resin having good slidability, is used. For the thin metal plate member 1211, a stainless steel plate having a thickness of 0.3 mm is used. The stainless steel plate is harder than the shutter portion body 1210 and has good abrasion resistance and corrosion resistance.

The press fit portions 1211C and 1211D of the thin metal plate member 1211 are press-fitted into between upper portions and between lower portions of the receiving portions 1210*a* and 1210*b* of the shutter portion body 1210, respectively. Consequently, the thin metal plate member 1211 can be secured to the shutter portion body 1210. As a result of employing the aforementioned values for the dimension h of the press fit portions 1211C and 1211D and the space H between the receiving portions 1210*a* and 1210*b*, the thin metal plate member 1211 can be press-fitted into the shutter portion body 1210 even taking manufacturing variation and thermal expansion difference into consideration. The press fit portions 1211C and 1211D of the thin metal plate member 1211 are formed so as to be substantially parallel to each other, and thus, no deformation of the part occurs in the press-fit process.

The thin metal plate member 1211 is secured to the shutter portion body 1210 by press-fitting the thin metal plate member 1211 into the upper and lower portion of the shutter portion body 1210. Consequently, as illustrated in FIG. 6C, the surface opposite to the abutment surface 1211A and a back surface of the restriction portion 1211B of the thin metal plate member 1211 are brought into surface-contact with the shutter portion body 1210. Consequently, during time from a sheet abutting against the thin metal plate member 1211 to the sheet passing by with its skew corrected, the thin metal plate member 1211 does not deform even though the sheet comes into pressure-contact with the abutment surface 1211A of the thin metal plate member 1211. Consequently, the sheet can stably be transported.

The abutting portion of each shutter portion 121 that abuts against a sheet is made of a thin metal plate member 1211. Consequently, when skew is corrected, even if a leading edge of a sheet is moved in the width direction while abutting against the shutter portion 121, almost no whittling of the shutter portion 121 occurs. The thin metal plate members 1211 are press-fitted into and secured to the respective shutter portion bodies 1210. Consequently, the thin metal plate members 1211 do not come off from the shutter portion bodies 1210 even upon receipt of, e.g., an impact during distribution.

In the present embodiment, parts of the shutter portion bodies 1210, that are brought into contact with the surfaces opposite to the abutment surfaces 1211A and the back surfaces of the restriction portions 1211B of the respective thin metal plate members 1211, are shaped so as to have a same height in the sheet transport direction. In other words, such parts of the shutter portion bodies 1210 have a same amount of protrusion from the metal plate member 120.

The identical thin metal plate members 1211 are attached to the shutter portion body 1210 by press-fitting the thin metal plate members 1211 into the upper and lower portions of the shutter portion body 1210. Consequently, in the respective shutter portions 121, positions of the abutment surfaces 1211A of the thin metal plate member 1211 are aligned with good accuracy. Consequently, a sheet transport apparatus 104 and a laser printer (image forming apparatus) 100 with an enhanced accuracy of skew correction for sheets S and good durability can be provided.

Although the present embodiment has been described in terms of a case where the thin metal plate members 1211 are attached to the shutter portion bodies 1210, the present invention is not limited to such case. For example, a member made from a material such as glass or ceramic may be used as long as such member has an abrasion resistance higher than that of the shutter portion bodies 1210 and is harder than the shutter portion bodies 1210.

Figure 4A:
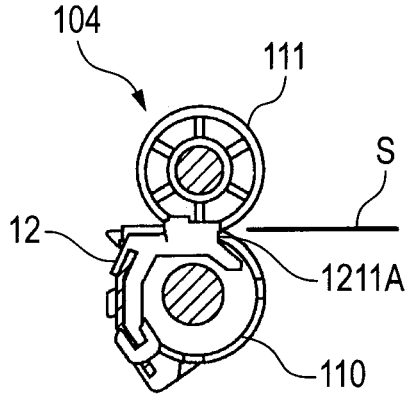
FIGS. 4A, 4B and 4C illustrate a skew correction operation performed by the skew correction apparatus.
Figure 4B:
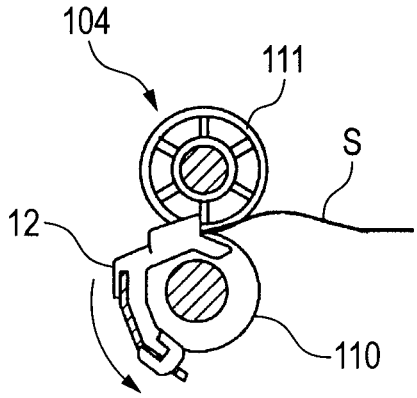
Figure 4C:
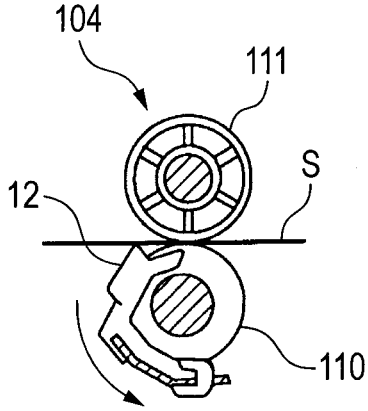

The shutter member 12 needs to return to the standby state illustrated in FIG. 4A from the position illustrated in FIG. 4C during time after a foregoing sheet has been passed by and before a leading edge of a subsequent sheet reaches the shutter member 12. The time for return of the shutter member 12 is shorter as the shutter member 12 is lighter. Also, for throughput enhancement, it is necessary to reduce a space between a rear edge of a foregoing sheet and a leading edge of a subsequent sheet S. Thus, for the thin plate members, a metal can be used because a metal enables the thin plate members to be manufactured so as to be light in weight and can be processed with good precision.

Figure 7A:
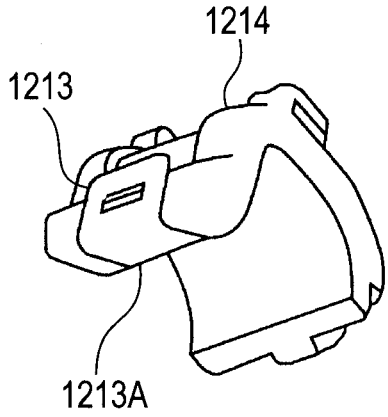
FIGS. 7A and 7B illustrate another method for securing a thin metal plate member to a shutter portion body of the shutter portion.
Figure 7B:
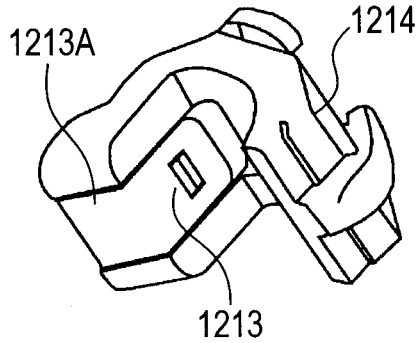

In the present embodiment, the thin metal plate members 1211 are secured to the shutter portion body 1210 by press-fitting. However, for example, as illustrated in FIGS. 7A and 7B, a thin metal plate member 1213 may elastically be secured to a shutter portion body 1214 by hooking the thin metal plate member 1213 on the shutter portion body 1214. FIG. 7A is a lower front perspective view of a shutter member 12 and FIG. 7B is a lower rear perspective view of a shutter member 12.

With such elastic securing method, it is difficult to ensure an accuracy of positions of abutment surfaces 1213A which a leading edge of a sheet S comes into contact with, and thus, attachment using press-fitting can be used. Instead of the thin metal plate members, the shutter portion bodies may be subjected to metal plating. However, in this case, it is difficult to separate the shutter portion bodies and the metal plating from each other at the time of disposal, and thus, securing using press-fitting can be used.

Figure 8:
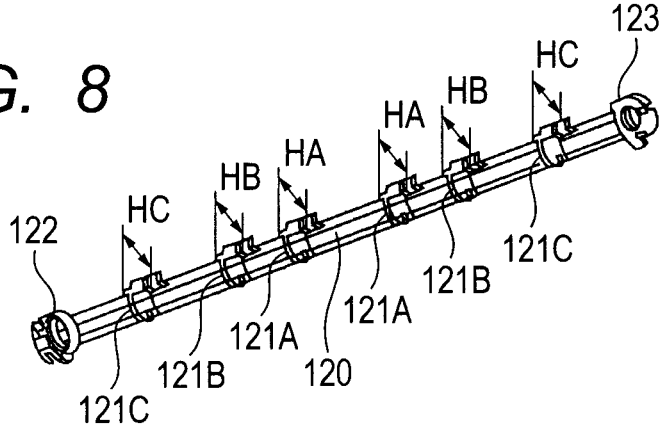
FIG. 8 is a perspective view of a shutter member of a skew correction apparatus provided in a sheet transport apparatus according to a second embodiment.

Next, a second embodiment of the present invention will be described. FIG. 8 is a perspective view of a shutter member of a skew correction apparatus provided in a sheet transport apparatus according to the present embodiment. Components in FIG. 8 that are the same as or correspond to those in FIGS. 3A and 3B are provided with reference numerals that are the same as those in FIGS. 3A and 3B. In the present embodiment, the shutter member is manufactured by forming a plurality of shutter portions 121 on the metal plate member 120 illustrated in FIG. 3A by integrated molding, symmetrically with a center in a width direction of the metal plate member 120 as a center.

FIG. 8 illustrates protrusion amounts HA of shutter portions 121A on the center side, protrusion amounts HB of shutter portions 121B on the respective end sides relative to the shutter portions 121A, and protrusion amounts HC of shutter portions 121C on the respective end sides relative to the shutter portions 121B from among the plurality of shutter portions 121. In the present embodiment, the three protrusion amounts HA, HB and HC have a relationship of HA>HB>HC. In the present embodiment, the shutter portions 121A, the shutter portions 121B and the shutter portions 121C are different from one another in positions of their respective abutment surfaces 1211A by 0.1 mm.

In other words, in the present embodiment, shutter portion bodies 1210 included in the shutter portions 121 on the respective end sides in the width direction protrude from the metal plate member 120 further toward the upstream side in a sheet transport direction than shutter portion bodies 1210 included in the shutter portions 121 on the center side in the width direction. Consequently, when a sheet is transported, the outer shutter portions 121 are brought into contact with a leading edge of the sheet S, enabling enhancement of the skew correction capability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-283367, filed Dec. 26, 2011, which is hereby incorporated by reference herein in its entirety.

What is claimed is:

1. A sheet transport apparatus comprising:

a transport portion that transports a sheet;

a skew correction portion that corrects a skew of the sheet transported by the transport portion, the skew correction portion including a resin member; and an abutting portion which is provided in the skew correction portion, and against which the leading edge of the sheet transported by the transport portion abuts, wherein the abutting portion includes metal, and an abrasion resistance of the metal is higher than that of the resin member.

2. The sheet transport apparatus according to claim 1, wherein the abutting portion is a thin metal plate member press fitted into and secured to the resin member.

3. The sheet transport apparatus according to claim 2, wherein the thin metal plate member includes two press fit portions respectively provided at each of opposite ends of an abutment part against which the leading edge of the sheet abuts, the press fit portions being press fitted into the resin member.

4. The sheet transport apparatus according to claim 3, wherein the press fit portions of the thin metal plate member are provided so as to face each other substantially in parallel to each other.

5. The sheet transport apparatus according to claim 1, wherein the abutting portion is metal plating provided on the resin member.

6. The sheet transport apparatus according to claim 1, wherein the skew correction portion moves to a position where the skew correction portion does not hinder the transport of the sheet after the skew correction.

7. The sheet transport apparatus according to claim 1, wherein the resin member includes polyacetal.

8. The sheet transport apparatus according to claim 1, wherein the abutting portion includes a stainless steel plate.

9. A sheet transport apparatus comprising:

a transport portion that transports a sheet;

a skew correction portion that corrects a skew of the sheet transported by the transport portion the skew corrections portion including a resin member and an abutting portion which is provided in the skew correction portion, and against which the leading edge of the sheet transported by the transport portion abuts, wherein the abutting portion includes glass or ceramic, and an abrasion resistance of the glass or ceramic is higher than that of the resin member.

10. A sheet transport apparatus comprising:

a transport portion that transports a sheet;

a skew correction portion against which a leading edge of the sheet transported by the transport portion abuts for skew correction;

a metal member provided in the skew correction portion so that the leading edge of the transported sheet abuts against the metal member; and a resin attachment portion which is provided in the skew correction portion and into which the metal member is press fitted.

11. The sheet transport apparatus according to claim 10, wherein the metal member includes two press fit portions respectively provided at each of opposite ends of an abutment part against which the sheet abuts, the press fit portions being press fitted into the resin attachment portion.

12. The sheet transport apparatus according to claim 11, wherein the press fit portions of the metal member are provided so as to face each other substantially in parallel to each other.

13. An image forming apparatus comprising:

a transport portion that transports a sheet;

a skew correction portion against which a leading edge of the sheet transported by the transport portion abuts for skew correction;

an image forming portion that forms an image on the sheet subjected to the skew correction by the skew correction portion;

a metal member provided in the skew correction portion so that the leading edge of the transported sheet abuts against the metal member; and a resin attachment portion which is provided in the skew correction portion and into which the metal member is press fitted.

14. The image forming apparatus according to claim 13, wherein the metal member includes two press fit portions respectively provided at each of opposite ends of an abutment part against which the sheet abuts, the press fit portions being press fitted into the resin attachment portion.

15. The image forming apparatus according to claim 14, wherein the press fit portions of the metal member are provided so as to face each other substantially in parallel to each other.

16. A sheet transport apparatus comprising:

a transport portion that transports a sheet;

a skew correction portion that corrects a skew of the sheet transported by the transport portion and includes a resin member; and an abutting portion which is provided in the skew correction portion, and against which a leading edge of the sheet transported by the transport portion abuts, wherein the abutting portion includes metal.

17. The sheet transport apparatus according to claim 16, wherein the resin member includes polyacetal.

18. The sheet transport apparatus according to claim 16, wherein the abutting portion includes a stainless steel plate.

19. A sheet transport apparatus comprising:

a transport portion that transports a sheet; and a skew correction portion that corrects a skew of a leading edge of the sheet transported by the transport portion, the skew correction portion comprising:

a main body which is made of resin; and a metal member which is provided in the main body, and against which the leading edge of the sheet transported by the transport portion abuts, wherein the moving portion is moved by the metal member being pressed by the sheet transported by the transport portion.

20. The sheet transport apparatus according to claim 19, wherein the metal member is a thin metal plate member press fitted into and secured to the main body.

21. The sheet transport apparatus according to claim 19, further comprising:

another skew correction portion; and a support member that movably supports the skew correction portion and the another skew correction portion.

22. A sheet transport apparatus comprising:

a transport portion that transports a sheet; and a plurality of moving members provided in a direction crossing a sheet transport direction, each of the plurality of moving members comprising:

a resin portion; and a metal portion which is provided in the resin portion, and against which a leading edge of the sheet transported by the transport portion abuts, wherein each of the plurality of moving members is moved by the metal portion being pressed by the sheet transported by the transport portion.

23. The sheet transport apparatus according to claim 22, wherein the plurality of moving members corrects a skew of the leading edge of the sheet transported by the transport portion.

24. The sheet transport apparatus according to claim 23, further comprising:

a supporting member configured to support the plurality of moving members.

* * * * *